US007891323B2

(12) United States Patent
Frach et al.

(10) Patent No.: US 7,891,323 B2
(45) Date of Patent: Feb. 22, 2011

(54) SELECTIVE CLEANING OF HEAT EXCHANGING DEVICES IN THE BOILER OF A COMBUSTION PLANT

(75) Inventors: Manfred Frach, Wesel (DE); Bernd Mussmann, Nordwalde (DE)

(73) Assignee: Clyde Bergemann GmbH (DE)

( * ) Notice: Subject to any disclaimer, the term of this patent is extended or adjusted under 35 U.S.C. 154(b) by 182 days.

(21) Appl. No.: 12/019,143

(22) Filed: Jan. 24, 2008

(65) Prior Publication Data

US 2008/0210178 A1 Sep. 4, 2008

Related U.S. Application Data

(63) Continuation of application No. PCT/EP2006/007042, filed on Jul. 18, 2006.

(30) Foreign Application Priority Data

Jul. 29, 2005 (DE) ..... 10 2005 035 556

(51) Int. Cl.
*F22B 37/48* (2006.01)

(52) U.S. Cl. ..... 122/1 R; 122/379; 122/380; 122/390; 15/316.1

(58) Field of Classification Search ..... 122/1 R, 122/379, 390; 15/316.1
See application file for complete search history.

(56) References Cited

U.S. PATENT DOCUMENTS

| | | | | |
|---|---|---|---|---|
| 4,603,660 | A * | 8/1986 | Wynnyckyj et al. | 122/379 |
| 6,323,442 | B1 * | 11/2001 | Jones | 177/132 |
| 6,892,679 | B2 * | 5/2005 | Jameel et al. | 122/379 |
| 7,341,067 | B2 * | 3/2008 | Jones et al. | 134/22.1 |

FOREIGN PATENT DOCUMENTS

| | | | |
|---|---|---|---|
| DE | 232749 | A1 | 2/1986 |
| DE | 19640337 | * | 3/1998 |
| DE | 19640337 | A1 * | 3/1998 |
| EP | 0101226 | A2 | 2/1984 |
| WO | 9305338 | | 3/1993 |

* cited by examiner

*Primary Examiner*—Gregory A Wilson
*Assistant Examiner*—Seth Greenia
(74) *Attorney, Agent, or Firm*—BainwoodHuang

(57) ABSTRACT

A boiler of a combustion plant has at least one heat exchanging device which can be traversed by a medium from an inlet to an outlet and is held in the interior of the boiler by means of at least one suspension device, wherein means for determining the temperature of the medium are provided at least at the inlet or at the outlet, and the at least one suspension device has means for determining the weight of the at least one heat exchanging device. Also proposed are a cleaning control device, a cleaning method and a method for operating a combustion plant which permit a considerable reduction in the cleaning expenditure, so that maintenance costs can be kept low.

25 Claims, 3 Drawing Sheets

SELECTIVE CLEANING OF HEAT EXCHANGING DEVICES IN THE BOILER OF A COMBUSTION PLANT

CROSS REFERENCE TO RELATED APPLICATIONS

This application claims priority under 35 U.S.C. §120 of PCT Application PCT/EP2006/007042 filed Jul. 18, 2006, the disclosure of which is hereby incorporated by reference.

BACKGROUND

The present invention relates to a boiler of a combustion plant comprising at least one heat exchanging device which can be traversed by a medium from an inlet to an outlet and is held in the interior space of the boiler by means of at least one suspension device. Also described is a cleaning control device for a boiler of a combustion plant with at least one heat exchanging device and at least one cleaning unit for removing combustion residues. The invention also relates to a cleaning method for the selective cleaning of at least one heat exchanging device in the boiler of a combustion plant, and to a method for operating a combustion plant. The invention is used in particular in the field of steam generation, of boiler plants heated with fossil fuels and/or additives, refuse combustion plants etc.

The residues from the combustion of coal and/or additive fuels lead, in operation of boilers of a combustion plant, to contamination of the heat exchanging surfaces, which has adverse effects on the operation of the combustion plant. The results are for example efficiency losses as a result of an increased waste gas temperature and/or a required relatively intense cleaning of the heat exchanging surfaces. In addition, the combustion plant must if appropriate be shut down in order to remove stubborn slag accumulations. It is also a problem that, under some circumstances, combustion residues can accumulate in a concentrated fashion at one position of the combustion plant, wherein said so-called "barbs" can possibly detach from the walls and cause damage as they impact against devices of the combustion plant. For these reasons, it is expedient for the combustion residues to be removed from the heat exchanging surfaces at predefined time intervals.

A plurality of different cleaning concepts is already known for cleaning heat exchanging surfaces of said type. For example, in addition to the mechanical cleaning (for example by means of so-called knocking devices or steel balls) and cleaning by means of compressed air or sound, cleaning of the heat exchanging surfaces by means of steam or water is often also resorted to. For cleaning, heat must firstly be extracted from the slag accumulations before they solidify. Cold water is particularly suitable as a cleaning medium for this purpose. The breakdown and detachment of the combustion residues is brought about by means of the sudden evaporation of the impinging and infiltrating water and the associated increase in volume and by means of the kinetic action of the impinging cleaning jet. The thermal shock action which is desired for the combustion residues can however lead to additional stresses in the tube material, which stresses can cause damage with uncontrolled use of the cleaning method. Blowing jet speed, cooling time, blowing jet geometry, water quantity and other factors determine the intensity of the thermal shock.

For cleaning by means of a blowing medium, translatorily movable and stationarily pivotable blowers are known. Movable blowers such as for example sliding blowers, lance blowers, longitudinally movable blowers, rotary tube blowers, rake blowers, are often used only for cleaning purposes in inner regions of the boiler. Said movable blowers are accordingly moved translatorily inwards, with the lance which conducts the cleaning medium if appropriate rotating, so that the nozzles which are attached to the lance clean the environment around the lance. In the case of stationarily pivotably attached blowers, for example, single nozzles, steam cannon blowers or else so-called automatic water lance blowers (manufacturer: Clyde Bergemann GmbH) are installed. In the case of the water lance blowers, the cold water is supplied with a pressure of 12 to 15 bar. The effective length of the blowing jet is approximately 20 to 22 m and the blowing area per blower is 200 to 400 m2, so that a cleaning unit of said type is particularly suitable for cleaning opposite wall regions of the boiler in the case of a free interior space. The blower generates a water jet whose impingement diameter is advantageously less than 1 m, so that a surface can be cleaned by means of targeted, meandering blowing patterns.

The cleaning with water jets briefly influences the combustion process, changes the behavior of various combustion regulating circuits and the steam quantity. The injected cold water also influences the flue gas temperature, the flue gas quantity and the transferred heat quantity. The cleaning of combustion chamber tube walls with water jets also loads the tube material, since the latter is subjected to increased heat stresses as a result of the thermal shock.

SUMMARY

It is an object of the present invention to at least partially solve the technical problems highlighted with regard to the prior art. It is intended in particular to specify a device with which selective and effective cleaning of heat exchanging devices in the interior of a boiler of a combustion plant can be carried out. It is likewise intended to specify methods which ensure careful cleaning with as constant a high efficiency of the combustion plant as possible.

Said objects are achieved by means of a boiler of a combustion plant as per the features of patent claim 1, a cleaning control device for a boiler of a combustion plant having the features of patent claim 8 and a cleaning process for the selective cleaning of at least one heat exchanging device as per the features of patent claim 9. Further advantageous embodiments are listed in the in each case dependent patent claims, with it being possible for the features specified individually in said dependent patent claims to be combined with one another in any desired technologically expedient manner and to lead to further embodiments of the invention.

The boiler of a combustion plant as proposed here comprises at least one heat exchanging device which can be traversed by a medium from an inlet to an outlet and is held in the interior space of the boiler by means of at least one suspension device. According to the invention, means for determining the temperature of the medium are provided at least at the inlet or at the outlet, and the at least one suspension device has means for determining the weight of the at least one heat exchanging device.

The boiler specified here is preferably a coal-fired, in particular brown-coal-fired boiler of a combustion plant. The invention described here is particularly advantageously designed for boilers having at least one vertically arranged interior space, shaft or so-called "flue" (in particular so-called "tower boilers" and/or "2-flue boilers"), in which a plurality of heat exchanging devices are positioned one above the other in a suspended fashion in the (vertical) interior space of the boiler. The waste gas of the combustion flows through or flows around the heat exchanging devices counter to the force of gravity, with heat from the hot waste gas being transferred to the heat exchanging devices.

The heat exchanging device is preferably embodied as a so-called tube bundle or as a tube hose. A heat exchanging device of said type accordingly comprises at least one, preferably multiply bent, tube which is traversed by a medium, for example water or steam, and by means of which the heat from the interior space of the boiler can be dissipated. Heat exchanging devices of said type span, for example, a cross section of the boiler of 20 m×20 m and have a height of up to 3 m. In the case of tower boilers for brown coal or black coal, it is for example possible for at least 5 or 7 such heat exchanging devices to be arranged one above the other. A heat exchanging device of said type has a separate circuit, so that the medium, in particular water or steam, is conducted into inner regions of the boiler via an inlet of the heat exchanging device and is conducted out again via an outlet. As it passes through the heat exchanging device, the medium absorbs heat energy.

It is possible to consider the temperature of the medium as a measure for the exchange of heat. Means for determining the temperature of the medium are therefore positioned at least at the inlet or at the outlet. Here, it is initially irrelevant whether the temperature of the medium is determined directly or indirectly, for example on the basis of the temperature of the line, etc. Here, the means are preferably positioned such that a temperature which is characteristic of the inlet of the medium is measured with a corresponding characteristic temperature of the medium close to the outlet. In the event of a desired, good heat transfer from the waste gas by means of the heat exchanging device to the medium, a relatively high temperature is to be measured close to the outlet. If slag, ash or some other combustion residue accumulates on the surface of the heat exchanging device over time, the heat transfer from the waste gas to the medium is hindered, so that the temperature of the medium close to the outlet becomes lower over time. The provision of such means for determining the temperature of the medium thus makes it possible to determine the extent to which an entire heat exchanging device still fulfils the desired function. It is thereby already possible to obtain a first statement regarding an imminent cleaning of the heat exchanging device, with it being possible from this to obtain only the information that an entire heat exchanging device is to be cleaned.

In light of the size of the heat exchanging device, a plurality of cleaning units are often used here, which cleaning units together would provide cleaning over a large volume. In order to obtain further information regarding the precise position of the accumulated combustion residues, the combination with further means is now specified here, such that more precise statements regarding the position of the combustion residues can be obtained. It is therefore proposed here that the at least one suspension device has means for determining the weight of the at least one heat exchanging device. On account of the combustion processes in the interior of the boiler or the positioning of fixtures in the interior of the boiler, preferred flow paths of the waste gas through the boiler partially occur. This results in a non-uniform distribution of combustion residues on the heat exchanging device. By providing means for determining the weight, it is possible to obtain statements regarding the weight distribution of the heat exchanging device, so that it can be determined which zones or partial regions of an individual heat exchanging device are particularly contaminated. On the basis of said knowledge, it is then possible to carry out selective cleaning of precisely only the heavily contaminated partial regions of the heat exchanging device.

Said particular combination of means for monitoring or determining locally delimited accumulations of combustion residues with regard to a heat exchanging device also has the advantage that the means proposed here for determining the temperature of the medium and the means for determining the weight of the heat exchanging device can be positioned outside the boiler, so that these are not exposed to the high thermal and dynamic loadings in the interior space of the boiler. It is thereby possible to produce more exact information, simplified data transmission is possible, and sensors and the like of simple construction can be used. There are also considerable advantages in terms of costs and assembly with regard to the capacity for retrofitting and repair of the means.

It is additionally to be considered that, as a result of the selectivity, only a reduced level of cleaning work is expended, so that the risk of damage to the heat exchanging devices is reduced and the thermal conditions in the interior space of the boiler are influenced only to a small extent. Where it was previously necessary to use all the soot blowers assigned to a heat exchanging device for a timespan of four to five hours for complete cleaning of a heat exchanging device, it is possible here for the quantity of cleaning medium or the time for cleaning to be considerably reduced.

According to one preferred embodiment, the means for determining the temperature of the medium comprise at least one evaluating unit which determines a temperature difference of the medium with respect to the inlet and the outlet. For the case in particular that it cannot be ensured that the medium flows into the heat exchanging device with a relatively constant temperature, it is advantageous to determine the input temperature and accordingly consider the temperature difference between the inlet and outlet of the medium as a measure for the present heat transfer with regard to a heat exchanging device. A large temperature difference implies that a good heat transfer is possible, that is to say the heat exchanging device is substantially free from combustion residues. In contrast, a small temperature difference shows that the medium has absorbed barely any heat as it has passed through the heat exchanging device, which is with great probability to be attributed to the accumulation of combustion residues on the heat exchanging device.

It is also proposed that the at least one suspension device comprises a plurality of support elements which is in each case fastened by means of at least one suspension point to the at least one heat exchanging device. The support elements are preferably tubes, struts, chains or the like which are positioned uniformly over a cross section of the boiler so as to hang down from a roof of the boiler. Said support elements preferably have a plurality of suspension points for a single heat exchanging device, so that for example a tube hose of said type or a tube bundle is fastened multiple times by means of one support element. Very particularly preferable is the embodiment of the suspension device such that also a plurality of heat exchanging devices is fixed in the interior space of the boiler with one support element.

According to a further embodiment of the boiler, the at least one suspension device and the at least one heat exchanging device are connected to one another by means of a plurality of suspension points, with the suspension points being arranged so as to be distributed uniformly in a plane transversely with respect to the force of gravity and in the region of the at least one heat exchanging device. The suspension points very particularly preferably form corner points for partial regions of the heat exchanging device, so that the heat exchanging device is divided similarly to a grid. The partial regions can have substantially the same area content, though this is not strictly necessary. The "uniform" distribution of suspension points has the advantage that precise information regarding the accumulation of combustion residues can be directly obtained over the cross section of the heat exchanging device or over the boiler. Here, the number and the location of the suspension points, if not predefined only on account of the weight of the heat exchanging devices which are to be supported, is advantageously to be selected such that the cleaning action of the provided cleaning units is taken into consideration. The suspension points with respect to which a weight determination is carried out are in particular selected so as to be positioned approximately in the region of the coverage range limit of the respective cleaning unit. It is thereby for example possible to detect and/or determine which of the cleaning units which are arranged adjacent to one another are now to be used.

Particularly preferable is the embodiment in which the means for determining the weight comprise at least one strain gauge. Here, strain gauges are to be understood in particular to mean planar measurement value pickups or sensors which can be characterized by an electrical resistance. When said strain gauges undergo a deformation, this results in a change in their electrical resistance. Such strain gauges are used in order to measure shape changes (expansions/contractions) at the surface of components such as for example the support elements of the suspension device. Such strain gauges are often composed of a type of measuring lattice which is either composed of a thin resistance wire laid in a meandering fashion or etched out of a thin film of resistor material. The measuring lattice is often fastened to a thin plastic support and provided with electrical connections. The electrical resistors formed by the measuring lattice are subjected to mechanical loadings during use, which mechanical loadings change their level of resistance. If a strain gauge is expanded, its resistance often increases. The change in the resistance is generally measured by connecting said strain gauge into an electrical circuit (Wheatstone measuring bridge), and is considered for the quantitative assessment of the load-induced deformation. Such strain gauges are relatively cheap and of simple construction, so that they can be integrated into the suspension device outside the boiler without great technical expenditure. It is thus for example possible for a characteristic number of the support elements to also be retrofitted with such strain gauges.

It is now also proposed that, in the boiler, at least one cleaning unit for removing combustion residues is provided on the at least one heat exchanging device, which cleaning unit can assume various operating states with regard to the cleaning action on partial regions of the at least one heat exchanging device. The embodiment in which a plurality (for example three, four or five) of cleaning units is provided is preferable. Said cleaning units, with regard to a heat exchanging device which is constructed with tubes, are preferably translatorily movable soot blowers which can be moved into inner regions of the heat exchanging device.

The cleaning action of the cleaning unit is for example influenced by the cleaning medium which is used, the blowing jet which is generated (with regard to number, pressure, shape and direction) and the manner of movement of the cleaning unit. In light of the fact that the device is to permit selective cleaning of the heat exchanging device, cleaning units are preferable which can targetedly clean the surface which is to be cleaned, and other partial regions less or not at all. It is thus for example possible for a targeted change in the pressure or the composition of the blowing medium (water/steam) to be possible. In addition, it is possible for special drives of the cleaning unit to be provided which permit targeted cleaning of the surface which is to be cleaned, for example by means of different feed speeds of the lance into the heat exchanging device, a variation of the rotational speed of the lance, the deactivation and activation of nozzles, etc. The cleaning action can advantageously be predefined in a flexible manner by means of a control unit.

The boiler can also be refined in that a control unit is provided which is connected to the means for determining the temperature of the medium, to the means for determining the weight of the at least one heat exchanging device and to at least one cleaning unit for removing combustion residues. Here, the control unit is supplied with items of information which firstly predetermine the selection of a cleaning unit and secondly, under some circumstances, influence the operating mode of the latter. For example, if a plurality of cleaning units are provided in a plurality of planes of the boiler, then it is possible, on the basis of the items of information which are obtained using the means for determining the temperature of the medium, to select the cleaning units at the level of the heat exchanging device which is to be cleaned. If the items of information which were obtained using the means for determining the weight of the at least one heat exchanging device now indicate that only a part of said heat exchanging device is to be cleaned, the number of cleaning units to be used can be further reduced and, with regard to the cleaning action, adapted to partial regions. A control unit of said type in particular also comprises data processing means and data processing programs.

According to a further aspect of the invention, a cleaning control device for a boiler of a combustion plant with at least one heat exchanging device and at least one cleaning unit for removing combustion residues is proposed, which cleaning control device comprises at least the following:

- at least one temperature sensor for determining a temperature of a medium in the at least one heat exchanging device,
- a plurality of weight sensors for determining the weight distribution of the at least one heat exchanging device,
- at least one control unit for activating at least one cleaning unit, and
- means for the data connection of the temperature sensor, weight sensors and control unit.

Said cleaning control device is preferably integrated into a boiler of the above-described type.

With regard to the temperature sensors specified here, reference is made substantially to the above description of the means for determining a temperature of the medium, in particular with regard to their arrangement. The embodiment of the temperature sensor itself is not of importance here. The embodiment in which two temperature sensors are provided per heat exchanging device, for example one at the inlet and one at the outlet of the medium, is preferable.

Here, the weight sensors fulfill the function as already described above in connection with the means for determining the weight. The weight sensors in particular comprise strain gauges. The arrangement of the weight sensors is selected here such that it is possible to make statements regarding the weight distribution.

The control unit for activating a cleaning unit is preferably integrated in a data processing system. Said control unit controls or regulates the activation and/or the cleaning action of a cleaning unit. For this purpose, the control unit can also be provided with a data store in which are stored for example reference limit values for the activation or the operating mode of the cleaning units. The control unit advantageously comprises all the necessary means to permit automatic operation of the selective cleaning of heat exchanging devices in a boiler.

The means for data connection can comprise cable, radio and similar connections as long as their functionality is not adversely affected in light of the prevailing ambient conditions.

A further aspect of the invention relates to a cleaning method for the selective cleaning of at least one heat exchanging device which can be traversed by a medium from an inlet to an outlet and is held in the interior space of a boiler of a combustion plant by means of at least one suspension device, which cleaning method comprises at least the following steps:

a) measuring at least one parameter of temperature or temperature difference of the medium in operation, b) measuring a weight distribution of the at least one heat exchanging device, c) identifying a surface, which is to be cleaned, of the at least one heat exchanging device, d) cleaning the identified surface.

Said cleaning method is preferably realized in the boilers described according to the invention or with the above-described cleaning control device.

With step a), the temperature and respectively the temperature difference of the medium with respect to each heat exchanging device, is measured and respectively determined and/or stored continuously or at predefined time intervals during operation of the combustion plant or of the boiler. With regard to step b), it is to be noted that the measurement of a weight distribution advantageously takes place together for a plurality of heat exchanging devices. By means of the items of information of temperature/temperature difference and weight distribution which are obtained in this way, the surface which is to be cleaned with regard to the heat exchanging devices which are to be cleaned are identified (step c). The cleaning (only) of the identified surface can take place separately with regard to one heat exchanging device or else simultaneously for a plurality of heat exchanging devices.

According to one refinement of the cleaning method, the heat exchanging device which is to be cleaned is determined by means of step a) and the surface, which is to be cleaned, of said heat exchanging device is determined by means of step b). In the case of a tower boiler, it is accordingly possible with step a) to identify the heat exchanging device which permits only a small heat transfer to the medium, or the height/level having the cleaning units suitable for cleaning said heat exchanging device. A further local, selective determination of the surface which is to be cleaned is now carried out by means of step b), in which regions with a weight increase are determined. Since the throughflow behavior of the waste gas through the tower boiler is often uniform, the values determined by means of step b) similarly apply for all heat exchanging devices provided therein.

It is also proposed that step d) is carried out only when a predefined value range of the surface which is to be cleaned is identified. This means in particular that, under some circumstances, a predefined number of partial regions and respectively a sufficiently large total area, with regard to one or more heat exchanging devices must firstly be present before a cleaning process is actually carried out. It is thus for example possible for an individual partial region to already be cleaned when the temperature difference of the medium between the inlet and outlet falls below a critical value, and/or with regard to a partial region of the heat exchanging device, a critical weight value is exceeded. On the other hand, it is however also possible that, in addition to said critical limit value, further limit values are defined at which, if appropriate, connected partial regions of one heat exchanging device and/or a plurality of surfaces of different heat exchanging devices are then cleaned simultaneously. The criteria for such a targeted implementation of the cleaning process are for example the time and the costs for cleaning, wherein in particular movement paths of the cleaning units and the quantity of cleaning medium used are to be considered.

Finally, with regard to the cleaning method, it is likewise proposed that it is advantageous if step d) comprises the cleaning of the identified surface with greater cleaning intensity than other partial regions of the at least one heat exchanging device. In connection with the greater cleaning intensity, reference is made to the above-described cleaning action of the cleaning units. Greater cleaning intensity can be described for example with a greater quantity of cleaning medium per unit area, a greater blowing energy per unit area and the like.

With regard to a method for operating a combustion plant, wherein the combustion plant has a plurality of heat exchanging devices which can in each case be traversed by a medium from an inlet to an outlet and are held in the interior space of a boiler of the combustion plant by means of a common suspension device, and also a plurality of cleaning units for removing combustion residues are provided on the heat exchanging devices, it is very particularly advantageous for a cleaning method of the type according to the invention as described above to be carried out during the operation of the combustion plant. This has the advantage that, on the one hand, the efficiency of the combustion plant is not significantly influenced, as was the case in known plants, which resulted in complete cleaning of the heat exchanging devices. In addition, the cleaning processes themselves can be reduced approximately to one fifth of the cleaning time of known plants, with it being possible for the quantity of cleaning medium used to also be reduced by for example more than 40%. The associated positive effects with regard to the operating costs and life expectancy of the heat exchanging devices are readily apparent.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Figure 1:
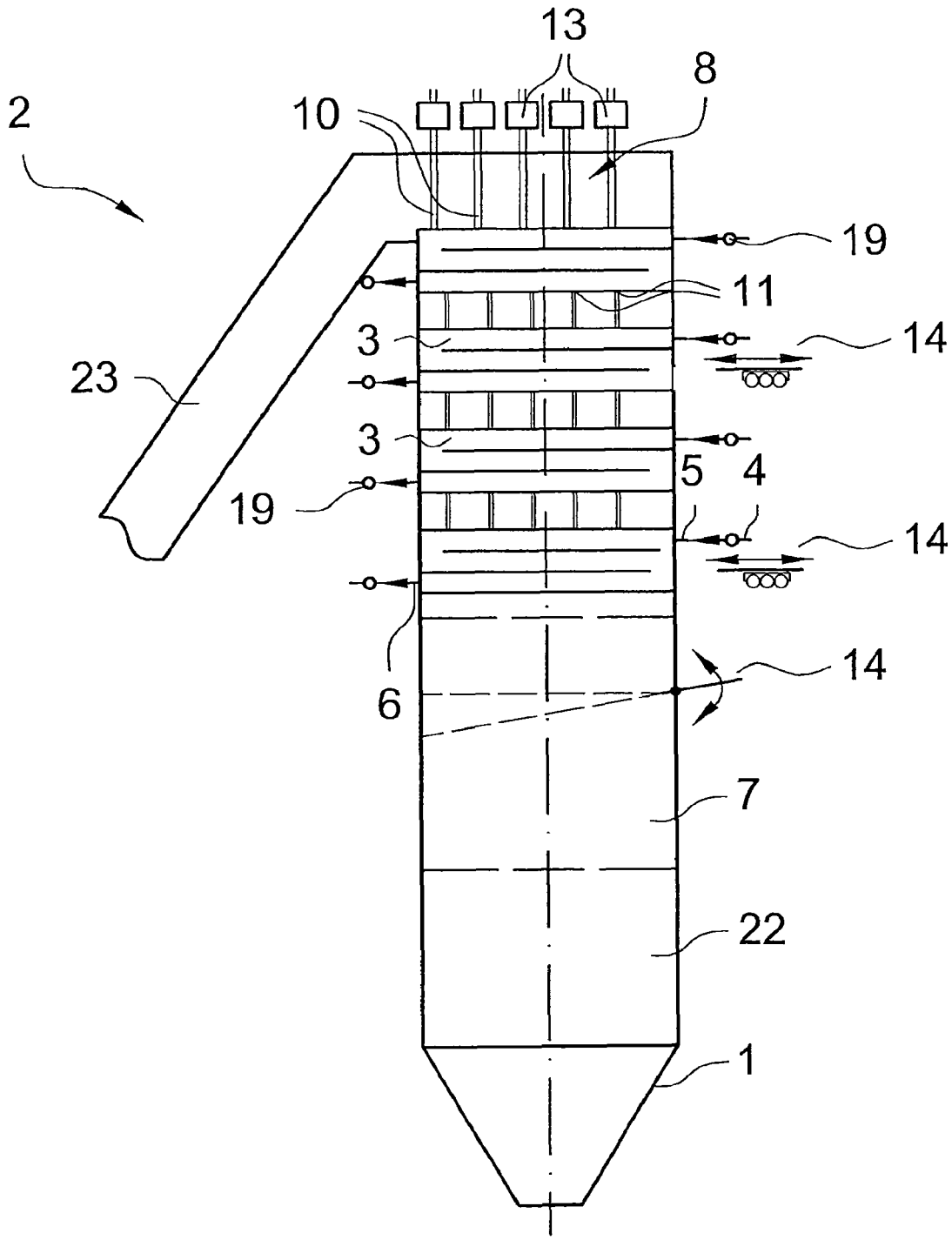
FIG. 1 schematically shows a boiler of a combustion plant.

FIG. 1 shows a boiler 1 in the form of a tower boiler, with coal or brown coal being burned in the combustion chamber 22 which is illustrated at the bottom, and with the waste gas flowing past and respectively through the heat exchanging devices 3, which are arranged above said combustion chamber 22, before finally being supplied via a flue gas line 23 to further devices (not illustrated here) of the combustion plant 2. The boiler 1 has, above the combustion chamber 22, a partial region of the interior space 7 which is substantially free from fixtures. Said region of the interior space 7 can preferably be cleaned by means of stationary blowers which are positioned so as to be pivotable permanently in a hatch of the boiler wall. It is possible to detect, for example by means of sensors in the opposite boiler wall, when cleaning is necessary, so that the pivotable cleaning units 14 can then be activated. Said pivotable cleaning units 14 clean the opposite wall of the boiler with freely predefinable blowing patterns and speeds.

A plurality of heat exchanging devices 3 are now positioned in the upper region of the boiler 1, which heat exchanging devices 3 are traversed by a medium 4 from an inlet 5 to an outlet 6. The four heat exchanging devices 3 which are arranged in the interior space 7 of the boiler 1 are held by means of a suspension device 8. In the embodiment variant illustrated, the suspension device 8 is formed by a plurality of support elements 10 which are in each case fastened by means of a plurality of suspension points 11 to the heat exchanging devices 3. The actual configuration of the suspension device 8 is fundamentally not of importance, so that the latter is also indicated only schematically here. Said suspension device 8 can be designed differently depending on the boiler type as well as with regard to the type, number and position of the heat exchanging devices, etc.

Each heat exchanging device 3 is formed with means for determining the temperature of the medium 4 at the inlet 5 and at the outlet 6, specifically with temperature sensors 19. The suspension device 8 is formed with means for determining the weight or the weight distribution together for all heat exchanging devices 3, with said means comprising strain gauges 13 for each support element 10. In the arrangement of the means for determining the weight or the weight distribution, it is essential that said means can generate a statement regarding the weight distribution over the cross section of the boiler 1 or of the heat exchanging device 3.

The temperature of the medium 4 is measured by means of the temperature sensors 19 during operation of the boiler 1. In addition, the weight distribution of the heat exchanging devices 3 is determined by means of the strain gauges 13. The surface, which is to be cleaned, of the corresponding heat exchanging device 3 is now identified from said characteristic variables, before said surface is finally cleaned by means of cleaning units 14 (preferably in the manner of a translatorily movable soot blower) illustrated here adjacent to the boiler 1.

Figure 2:
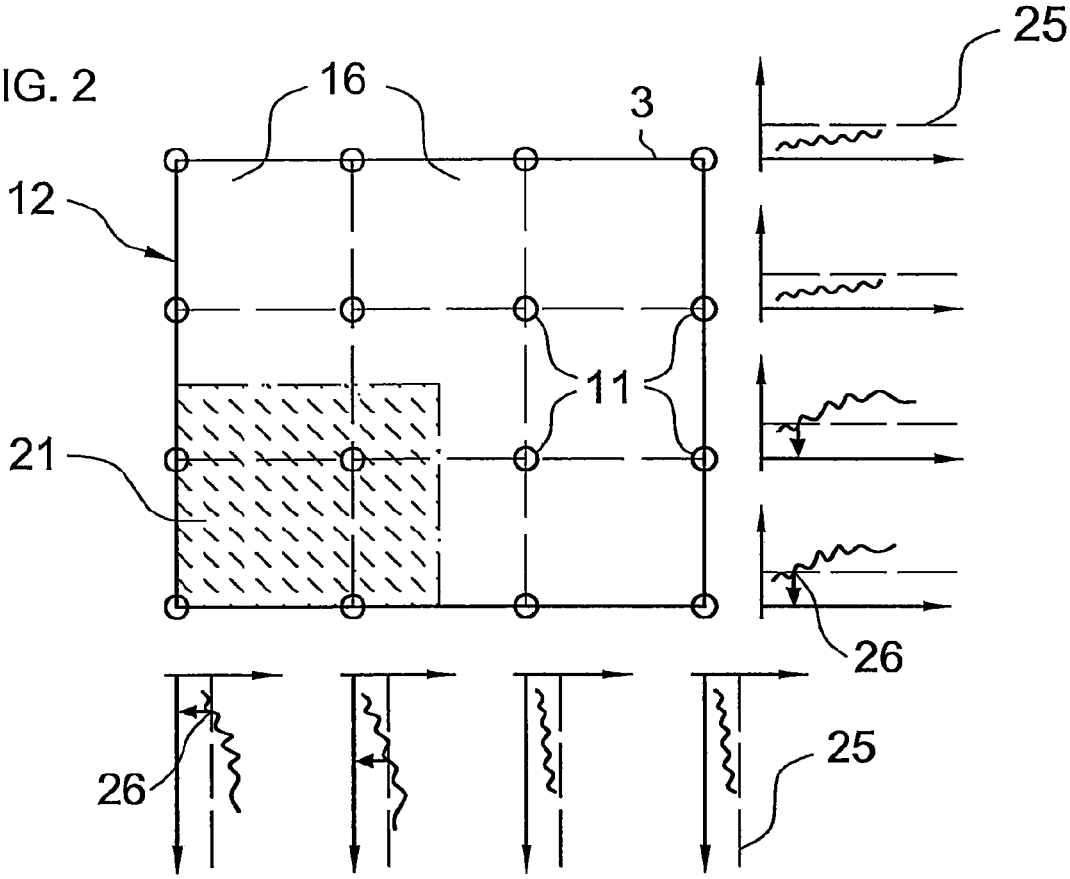
FIG. 2 schematically shows a heat exchanging device as a schematic plan view, FIG. 3 schematically shows a detail of a boiler with a cleaning control device, FIG. 4 schematically shows a visualization of the interaction of a cleaning control device with sensors and cleaning unit, FIG. 5 schematically shows a cleaning cycle with regard to a heat exchanging device.

FIG. 2 schematically shows a plan view of a heat exchanging device 3 as for example spans the cross section of an embodiment variant of a boiler 1. The heat exchanging device 3 is fixed, in a horizontal plane 12, to the suspension device 8 (not illustrated) by means of a plurality of suspension points 11. The suspension points 11 are arranged here so as to be distributed regularly and respectively uniformly in the plane 12, so that different partial regions 16 can be delimited by said suspension points 11. In the embodiment variant illustrated, the suspension points 11 are arranged in rows and columns which are aligned perpendicular to said rows. Illustrated adjacent to said rows and columns are individual diagrams which show the time profile of the weight of the heat exchanging device.

Illustrated by way of example at the right in FIG. 2 are the data which have been determined during the evaluation of the strain gauges 13 which are attached to one or more support elements 10 which are fastened to the respective row (as visualized in FIG. 1). The diagrams now visualize a limit value 25 with regard to the weight and a time 26 at which said limit value 25 is exceeded. As can be seen from the diagrams depicted at the right, with regard to the two lower rows of suspension points 11, an exceedance of the limit value 25 has already been detected, wherein said exceedances took place at different times 26.

Shown in a similar way is the column-wise evaluation of the weight distribution. The diagrams illustrated at the bottom in FIG. 2 in turn show, by way of example, the weight change over time. In the diagrams illustrated at the bottom left, the limit value 25 with regard to a critical weight has likewise been exceeded in each case at a different time 26.

In the situation illustrated by way of example here, it is now possible by means of a suitable cleaning control device 18 (not illustrated) to detect that, with regard to one (and respectively all) heat exchanging device(s) 3, an accumulation of combustion residues is present in the bottom left region, so that the surface 21 which is to be cleaned is situated here. In order to clarify the question of which heat exchanging device 3 of the plurality is now actually to be cleaned, the temperature of the medium can be considered.

Figure 3:
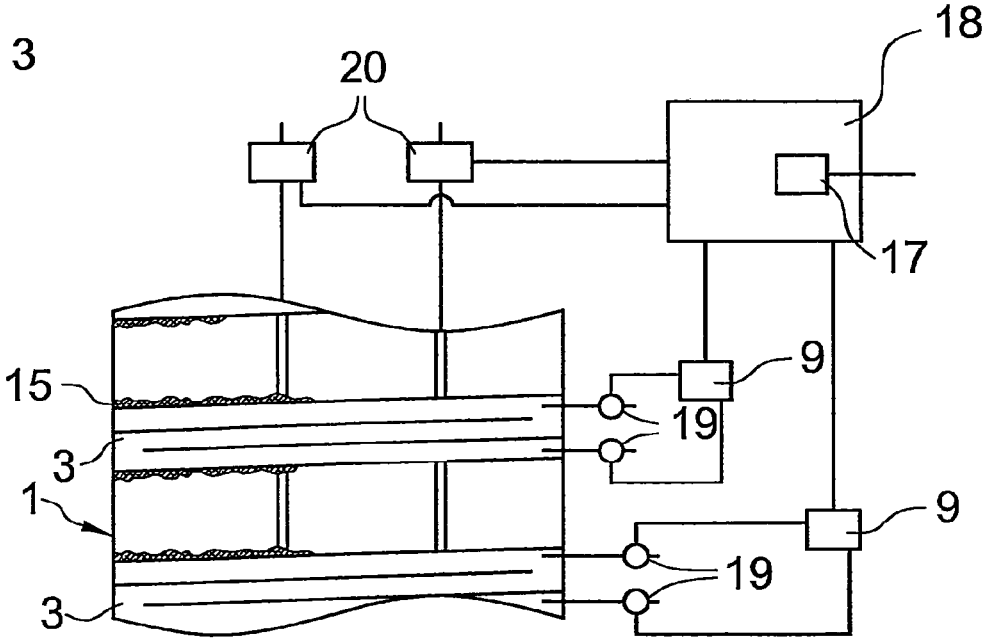

FIG. 3 visualizes a possible situation in a boiler 1, with a plurality of heat exchanging devices 3 again being provided. On account of the operation of the combustion plant and respectively the boiler 1, a single-sided accumulation of combustion residues 15 takes place. As a result of said single-sided accumulation, increased tensile forces are applied to the support elements 10 in said region, which increased tensile forces lead to a length variation of the support element 10 which can be measured by means of weight sensors 20 (for example in the manner of a strain gauge). On account of the more intense loading of the support element 10 which is illustrated at the left, different measurement values are measured by means of the weight sensors 20 and passed on to a cleaning control device 18. In order to permit selective cleaning of the heat exchanging device 3, the temperature difference of the medium with regard to the inlet and the outlet is additionally determined with regard to each heat exchanging device 3. For this purpose, temperature sensors 19 are positioned close to the inlet and the outlet, with an evaluating unit 9 determining a temperature difference of the medium. The results of said evaluating unit 9 are likewise provided to the cleaning control device 18. Proceeding from said measurement values of the weight sensors 20 and respectively of the temperature sensors 19, an activation of cleaning units (not illustrated) now takes place in a targeted fashion on the basis of the control unit 17. It is to be explicitly pointed out here that in particular the evaluating units 9 can be combined with one another and can if appropriate also be part of the cleaning control device 18. It is likewise also possible that the data transfer is carried out from a cleaning control device 18 to a remotely situated control unit 17.

Figure 4:
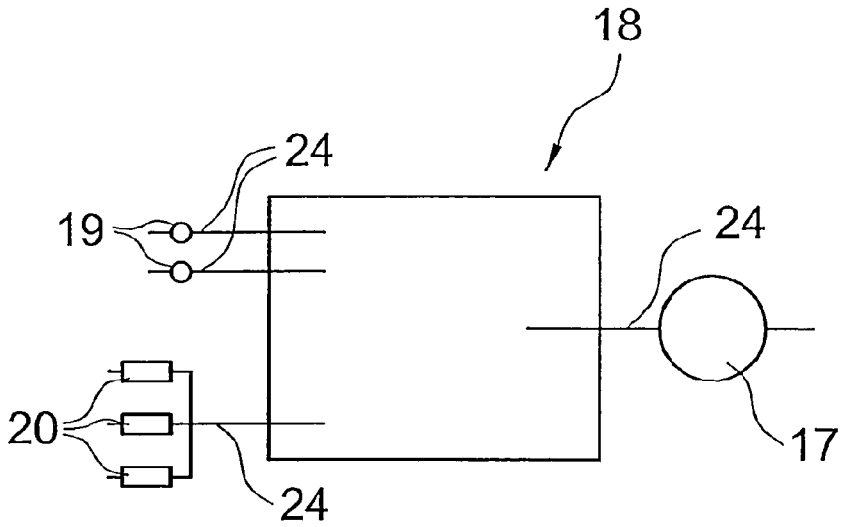

FIG. 4 shows a schematic illustration of a further embodiment variant of a cleaning control device 18. The cleaning control device 18 is particularly suitable for use with a boiler of a combustion plant having at least one heat exchanging device and at least one cleaning unit for removing combustion residues. The cleaning control device 18 comprises a plurality of temperature sensors 19 for determining a temperature of the medium in the heat exchanging devices (not illustrated), a plurality of weight sensors 20 for determining the weight distribution of the at least one heat exchanging device, a control unit 17 for activating at least one cleaning unit (not illustrated) and data connections 24 to the temperature sensors 19, weight sensors 20 and the control unit 17. A cleaning control device 18 of said type can also be a constituent part of a data processing system, a data carrier and/or an operating method.

Figure 5:
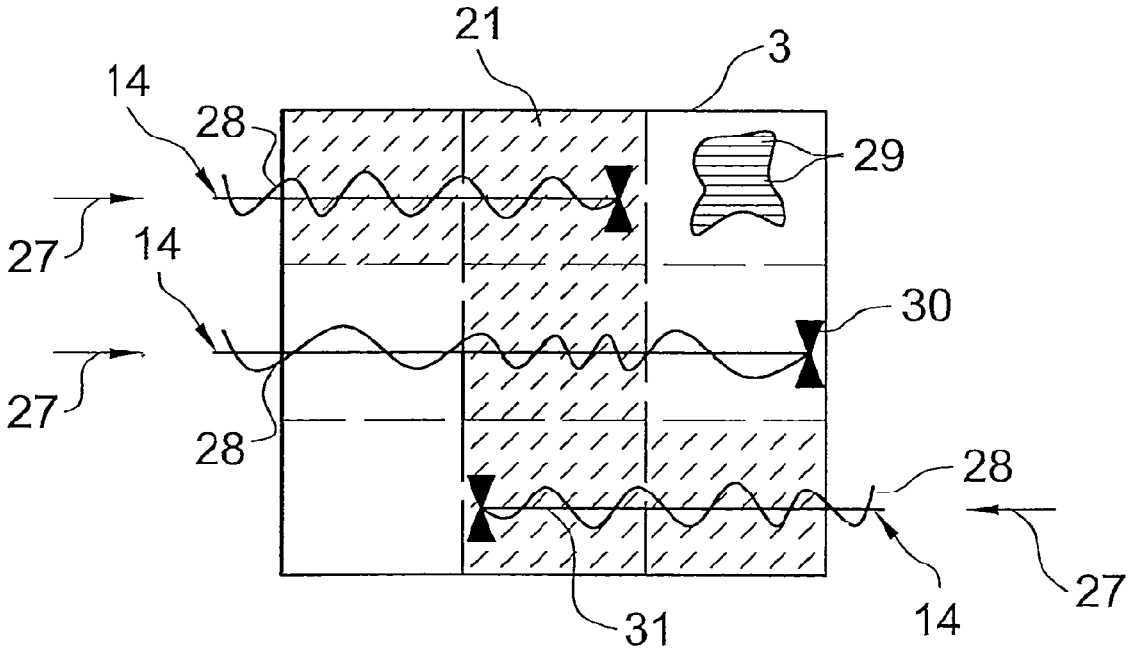

FIG. 5 should now also visualize the cleaning method itself. Illustrated is a heat exchanging device 3 which is formed with a plurality of tubes 29. As has for example already been explained with regard to FIG. 2, said heat exchanging device 3 can be divided into a plurality of partial regions 16, wherein surfaces 21, which are to be cleaned, of the heat exchanging device 3 can be identified using the means for determining the temperature of the medium and the means for determining the weight distribution. The identification of the surface 21 to be cleaned has already been carried out in the illustrated situation, so as to result in the shaded surface 21 which is to be cleaned.

A plurality of cleaning units 14 can be used for cleaning said heat exchanging device 3, with three cleaning units 14 being illustrated here. Said cleaning units 14 are preferably a type of soot blower which can be inserted with a feed direction 27 into inner regions of the heat exchanging device 3, so that its blowing jet 30 can act in intermediate spaces between the tubes 29.

For the cleaning plan which results here, with the cleaning unit 14 which is illustrated at the top, a feed direction 27 from left to right is realized, with the cleaning unit 14 being operated with a substantially constant rotation 28 of the lance 31, which is to be visualized by the uniform profile of the corrugated line.

The cleaning unit 14 illustrated below is duly moved in a translatory fashion with the same feed direction 27, but at a different speed. In the case of said cleaning unit 14, the rotation 28 has been maintained with the same speed, with an increased feed speed having been realized in those partial regions of the heat exchanging device 3 which do not need to be cleaned, which feed speed has, in contrast, been slowed in relation to the other cleaning units 14 in the region of the surface 21 which is to be cleaned. An increased output of cleaning medium is thereby made possible in said region.

Likewise illustrated at the bottom of FIG. 5 is a cleaning unit 14 which operates in a similar manner to the cleaning unit illustrated above, but with an opposite feed direction 27.

It is also proposed that the cleaning units 14 operate with an increased pressure in the region of the surface 21 which is to be cleaned, so that the cleaning medium (water) is output here at approximately 20 bar into the environment or toward the heat exchanging device 3, while outside the surface 21 which is to be cleaned, said cleaning units 14 operate only with a pressure of approximately 10 bar.

With the present invention, the risk of damage to parts of the boiler or of the combustion plant can be reduced. In addition, the cleaning cycles, presently 4 to 5 hours per heat exchanging device, can be reduced in part to less than 1 hour. The use of the cleaning medium (for example of steam) can also be reduced by up to 50%. The for carrying out the means used in the cleaning method are cost-effective and can be easily integrated into existing internal combustion engines outside the boiler without great thermal and/or dynamic loading. A particularly effective combination of measurement means for combustion residues on heat exchanging devices is therefore specified.

LIST OF REFERENCE SYMBOLS

1 Boiler
2 Combustion plant
3 Heat exchanging device
4 Medium
5 Inlet
6 Outlet
7 Interior space
8 Suspension device
9 Evaluating unit
10 Support element
11 Suspension point
12 Plane
13 Strain gauge
14 Cleaning unit
15 Combustion residue
16 Partial region
17 Control unit
18 Cleaning control device
19 Temperature sensor
20 Weight sensor
21 Surface
22 Combustion chamber
23 Flue gas line
24 Data connection
25 Limit value
26 Time
27 Feed direction
28 Rotation
29 Tube
30 Blowing jet
31 Lance While various embodiments of the invention have been particularly shown and described, it will be understood by those skilled in the art that various changes in form and details may be made therein without departing from the spirit and scope of the invention as defined by the appended claims.

What is claimed is:

1. A boiler of a combustion plant comprising a plurality of heat exchanging devices, each of which being constructed with tubes, wherein each heat exchanging device has an inlet and an outlet for a medium that can flow through the tubes of each heat exchanging device from the respective inlet to the respective outlet and the plurality of heat exchanging devices are held in the interior space of the boiler one above the other in a suspended fashion by means of one common suspension device, the plurality of heat exchanging devices span a cross section of the boiler, and with means for separately determining the temperature of the medium of each heat exchanging device being provided at least at the respective inlet or at the respective outlet of each heat exchanging device and are positioned outside of the boiler, and the one common suspension device having means for determining the weight of the plurality of heat exchanging devices.

2. The boiler as claimed in claim 1, in which the means for determining the temperature of the medium comprises at least one evaluating unit which determines a temperature difference of the medium with respect to the inlet and the outlet.

3. The boiler as claimed in claim 1, in which the one common suspension device comprises a plurality of support elements which is in each case fastened by means of at least one suspension point to the heat exchanging devices.

4. The boiler as claimed in claim 1, wherein the one common suspension device and the heat exchanging devices are connected to one another by means of a plurality of suspension points, in which the suspension points are arranged so as to be distributed uniformly in a plane transversely with respect to the force of gravity and in the region of the heat exchanging devices.

5. The boiler as claimed in claim 1, in which means for determining the weight comprise at least one strain gauge.

6. The boiler as claimed in claim 1, in which at least one cleaning unit for removing combustion residues is provided on the heat exchanging devices, which cleaning unit can assume various operating states with regard to the cleaning action on partial regions of the heat exchanging devices.

7. The boiler as claimed in claim 1, in which a control unit is provided which is connected to the means for determining the temperature of the medium, to the means for determining the weight of the heat exchanging devices and to at least one cleaning unit for removing combustion residues.

8. A cleaning control device for a boiler of a combustion plant with a plurality of heat exchanging devices each being constructed with tubes, wherein each heat exchanging device has an inlet and an outlet for a medium that can flow through the tubes of each respective heat exchanging device from the respective inlet to the respective outlet, wherein the heat exchanging devices span a cross section of the boiler and are held one above the other in a suspended fashion by means of one common suspension device, and at least one cleaning unit for removing combustion residues, comprising at least at least one temperature sensor at least at the respective inlet or the respective outlet of each heat exchanging device and are positioned outside of the boiler for separately determining a temperature of a medium in the tubes of heat exchanging device, a plurality of weight sensors for determining the weight distribution of the plurality of heat exchanging devices, at least one control unit for activating at least one cleaning unit, and means for the data connection of the temperature sensor, weight sensors and control unit.

9. A cleaning method for the selective cleaning of a plurality of heat exchanging devices, each of which being constructed with tubes, wherein each heat exchanging device has an inlet and an outlet for a medium that can flow through said tubes of each respective heat exchanging device from the respective inlet to the respective outlet and the plurality of heat exchanging devices are held in the interior space of a boiler of a combustion plant one above the other in a suspended fashion by means of one common suspension device, the heat exchanging devices span a cross section of the boiler, which cleaning method comprises at least the following steps:

a) measuring at least one parameter of temperature or temperature difference of the medium in the tubes of each heat exchanging device in operation at least at the respective inlet or at the respective outlet of each heat exchanging device and are positioned outside of the boiler, b) measuring a weight distribution of the plurality of heat exchanging devices, c) identifying a surface, which is to be cleaned, of the heat exchanging devices, d) cleaning the identified surface.

10. The cleaning method as claimed in claim 9, in which the heat exchanging device which is to be cleaned is determined by means of step a) and the surface, which is to be cleaned, of said heat exchanging device is determined by means of step b).

11. The cleaning method as claimed in claim 9, in which step d) is carried out only when a predefined value range of the surface which is to be cleaned is identified.

12. The cleaning method as claimed in claim 9, in which step d) comprises the cleaning of the identified surface with greater cleaning intensity than other partial regions of the heat exchanging devices.

13. A method for operating a combustion plant, wherein the combustion plant has a plurality of heat exchanging devices which can in each case be traversed by a medium from an inlet to an outlet and are held in the interior space of a boiler of the combustion plant by means of a common suspension device, and also a plurality of cleaning units for removing combustion residues are provided on the heat exchanging devices, in which method a cleaning method as claimed in claim 9 is carried out during the operation of the combustion plant.

14. The boiler as claimed in claim 1, in which the plurality of heat exchanging devices span a cross section of the boiler of 20 m×20 m and have a height up to 3 m.

15. The boiler as claimed in claim 1, in which at least 5 or 7 heat exchanging devices are disposed one above the other.

16. The boiler as claimed in claim 1, in which the means for separately determining the temperature of the medium and the means for determining the weight of the plurality of heat exchanging devices are positioned outside the boiler.

17. The boiler as claimed in claim 1, in which one temperature sensor is provided at the inlet and one temperature sensor is provided at the outlet of each heat exchanging device.

18. The boiler as claimed in claim 1, in which the one common suspension device has means for determining the weight of all heat exchanging devices.

19. The boiler as claimed in claim 1, in which the one common suspension device has means for determining the weight distribution of all heat exchanging devices together.

20. The boiler as claimed in claim 1, in which the heat exchanging devices are held in a horizontal plane.

21. The boiler as claimed in claim 9, in which the measuring of the weight distribution is carried out by means generating a statement for the weight distribution for all heat exchanging devices.

22. A boiler of a combustion plant, comprising:

a plurality of horizontally oriented heat exchanging devices arranged in a vertical stack in an interior space above a combustion chamber of the boiler, each heat exchanging device spanning a cross section of the boiler, each heat exchanging device being constructed with one or more horizontally oriented tubes and having a respective inlet and outlet for a medium to flow through the tubes of the heat exchanging device;

a suspension device having a plurality of support elements by which the vertical stack of heat exchanging devices is suspended, the suspension device including an array of weight sensors to measure the weight of the vertical stack of heat exchanging devices at respective horizontal locations, the support elements partly defining a plurality of substantially distinct horizontal cleaning regions of each of the heat exchanging devices;

a plurality of temperature sensors arranged outside the boiler at respective inlets and outlets of the heat exchanging devices to determine the temperature of the medium at the respective inlets and outlets;

at least one cleaning unit at an outer wall of the boiler; and a controller operative in response to weight and temperature data from the weight and temperature sensors to:

calculate a weight distribution across the horizontal extent of the stack of heat exchanging devices and, based on the weight distribution, identify one or more horizontal locations of excessive slag build-up, each identified horizontal location corresponding to a set of vertically aligned horizontal cleaning regions of the vertical stack of heat exchanging devices;

calculate a respective temperature difference for each of the heat exchanging devices and, based on temperature differences, identify one or more heat exchanging devices having excessive slag build-up; and selectively operate the at least one cleaning unit to clean substantially only those horizontal cleaning regions of the identified heat exchanging devices which correspond to the identified horizontal locations.

23. The boiler as claimed in claim 22, wherein the heat exchanging devices fully span a cross section of the boiler.

24. The boiler as claimed in claim 22, wherein the at least one cleaning unit is provided adjacent the heat exchanging devices.

25. The boiler as claimed in claim 22, having a plurality of cleaning units being divided into sets with each set configured to clean a respective one of the heat exchanging devices.

* * * * *